US006273316B1

(12) United States Patent
Losada

(10) Patent No.: US 6,273,316 B1
(45) Date of Patent: Aug. 14, 2001

(54) FASTENER FEEDING SYSTEM FOR POWER ACTUATED GUN

(76) Inventor: Alfonso Losada, 204 Foline Dr., Bridgeport, CT (US) 06606

( * ) Notice: Subject to any disclaimer, the term of this patent is extended or adjusted under 35 U.S.C. 154(b) by 0 days.

(21) Appl. No.: 09/403,109

(22) PCT Filed: Apr. 15, 1998

(86) PCT No.: PCT/US98/08060

§ 371 Date: Oct. 14, 1999

§ 102(e) Date: Oct. 14, 1999

(87) PCT Pub. No.: WO98/47668

PCT Pub. Date: Oct. 29, 1998

Related U.S. Application Data

(60) Provisional application No. 60/046,826, filed on Apr. 24, 1997.

(51) Int. Cl.[7] ..... B25B 23/00

(52) U.S. Cl. ..... 227/119; 227/136; 227/18

(58) Field of Search ..... 227/109, 119, 227/120, 135, 136, 137, 15, 17, 18

(56) References Cited

U.S. PATENT DOCUMENTS 3,157,884 11/1964 Decot et al. .
3,554,246 1/1971 Halstead .
4,014,488 3/1977 Potucek .
4,246,939 1/1981 Boegel .
5,052,607 10/1991 Dutton .
5,199,625 4/1993 Dewey et al. .
5,417,534 5/1995 Losada .
5,568,753 10/1996 Habermehl et al. .
5,634,583 6/1997 McGuinness et al. .

*Primary Examiner*—Scott A. Smith
(74) *Attorney, Agent, or Firm*—Fattibene & Fattibene; Paul A. Fattibene; Arthur T. Fattibene

(57) ABSTRACT

A fastener feeding mechanism for a power actuated gun (10, 310, 410, 510) having a track (16, 316, 416, 516) for holding a plurality of fasteners (18, 318, 636). Fasteners are biased by a spring (32, 372, 672) down the track towards a holding or latch mechanism (22, 322, 422, 522). The holding or latch mechanism has a retractable latch. The holding or latch mechanism holds a fastener in a predetermined position to be driven into a substrate. A guide (14, 314, 414, 514) attached to a barrel (12, 312, 412, 512) of a power actuated gun guides the barrel permitting the barrel to be advanced for firing and driving the fastener. After firing a bias on the guide causes the barrel to be retracted for the positioning of another fastener to be driven. The present invention greatly facilitates the driving of fasteners having a plate, and permits the driving of fasteners quickly resulting in more efficient and therefore less costly construction.

4 Claims, 12 Drawing Sheets

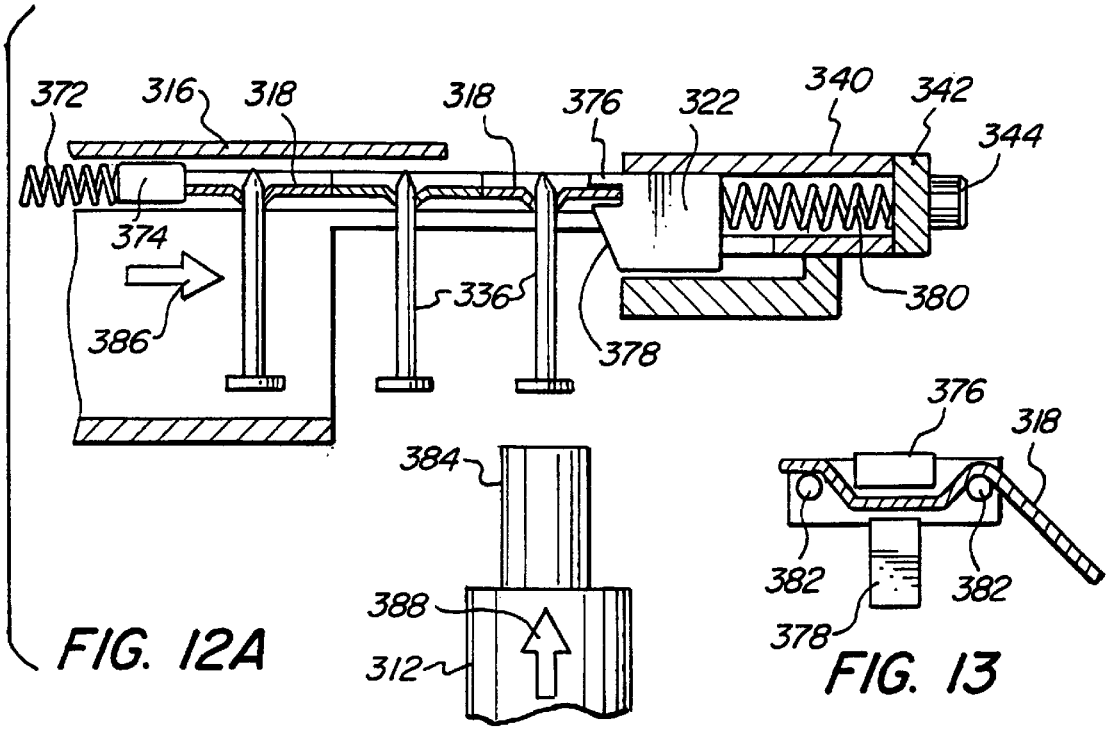
FIG. 12A
FIG. 13
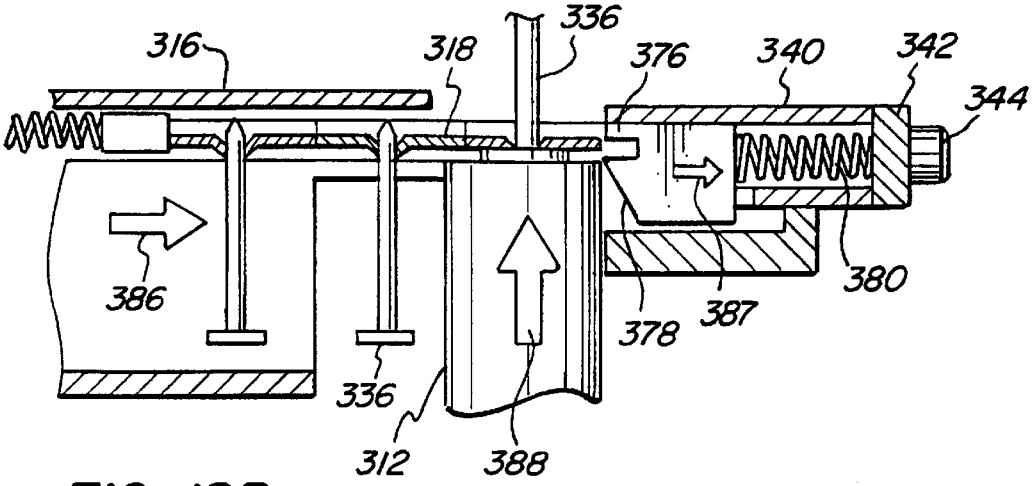
FIG. 12B

FASTENER FEEDING SYSTEM FOR POWER ACTUATED GUN

RELATED APPLICATION

This application claims the benefit of U.S. Provisional Application No. 60/046,826 filed Apr. 24, 1997.

FIELD OF THE INVENTION

The present invention relates in general to a power actuated gun as used to drive fasteners having a plate or washer and a stud, and more particularly to a track feeding system for use with a power actuated gun and fastener.

BACKGROUND OF THE INVENTION

Power actuated guns are used in many industrial applications, and particularly construction applications. A power actuated gun is often used to drive a fastener into a relatively hard substrate, such as concrete. The power actuated gun is typically powered by an explosive charge. Generally, a fastener is used having a nail frictionally retained in a washer or plate. One such fastener assembly is disclosed in U.S. Pat. No. 4,736,923 entitled "Fastener Assembly" issuing to Losada on Apr. 12, 1988, which is herein incorporated by reference. Fasteners are generally available loosely packed and are individually placed into the barrel of a power actuated gun prior to firing or driving. While this process of individually loading and firing or driving a fastener results in secure fastening to a relatively hard substrate, the process is typically slow, time consuming, and therefore costly. Additionally, in many applications fasteners need to be driven into ceiling areas that are hard to reach from the ground or floor. In using a power actuated gun to drive fasteners into a ceiling, the user or worker often has to climb a ladder with the power actuated gun, and individually load the barrel of the power actuated gun with a fastener, while holding onto the ladder. This is often difficult and dangerous. As a result another method is sometimes used in which the power actuated gun is placed onto a pole and raised to the ceiling while the user or worker remains on the ground or floor. While this saves effort and time in not having to climb a ladder, the power actuated gun has to be lowered, reloaded with a fastener, and raised again each time a fastener is driven. This is inconvenient, tiring, and slower than necessary. Accordingly, there is a need to improve the use of power actuated guns to make their use safer, easier, and more efficient.

SUMMARY OF THE INVENTION

The present invention is directed to a track feeding system for use with a power actuated gun and loose fasteners, especially fasteners having a plate. A track is adapted to receive a plurality of fasteners at one end and has an opening at the other end for dispensing a fastener. A spring biases the plurality of fasteners along the track to the dispensing end. A releasable latch is used at the dispensing end to hold the fastener in position prior to being driven into a substrate by the power actuated gun. The track is attached to the barrel of a power actuated gun by a guide mechanism that biases the barrel of the power actuated gun away from the fastener prior to firing. The guide mechanism can be compressed causing the barrel of the power actuated gun to contact the fastener being held in position by the latch. In one embodiment the barrel of the power actuated gun contacts a cam surface on the latch causing the latch to release the fastener. In another embodiment a remote cocking and firing mechanism is used.

Accordingly, it is an object of the present invention to increase the efficiency of driving fasteners.

It is a further object of the present invention to permit multiple firing of a power actuated gun without the need for individually reloading fasteners in the power actuated gun.

It is an advantage of the present invention that fasteners having a plate may be used.

It is another advantage of the present invention that loose fasteners may be used without the need for attaching the fasteners together for feeding.

It is a feature of the present invention that a releasable latch is used.

It is another feature of the present invention that a guide mechanism is used to advance the barrel of a power actuated gun into position to drive a fastener.

It is yet another feature of the present invention that different power actuated guns may be used with practically no modifications.

These and other objects, advantages, and features will become more apparent in view of the following detailed description.

BRIEF DESCRIPTION OF THE DRAWINGS

FIGS. 12A and 12B is a partial cross section of a portion of the invention illustrating the operation of the feeding mechanism.

FIG. 13 is an elevational view more clearly illustrating the clip holding mechanism.

DETAILED DESCRIPTION OF THE PREFERRED EMBODIMENTS

Figure 1:
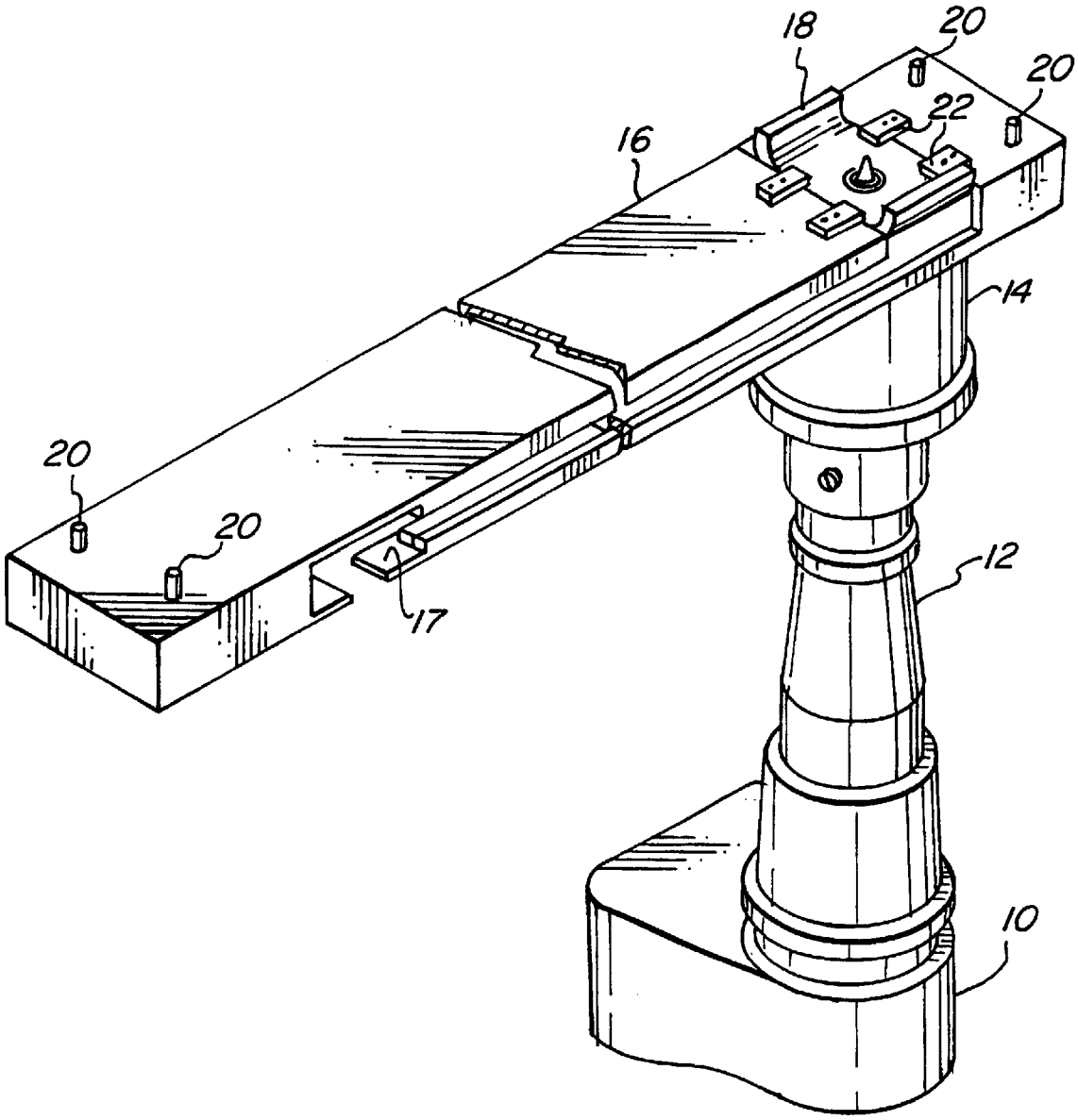
FIG. 1 is a perspective view of the present invention.

A power actuated gun 10 has a barrel 12. A cylindrical attachment 14 is placed on barrel 12. Attached to the cylindrical attachment 14 is a track 16. Track 16 contains a plurality of clips or fasteners 18 therein which have a plate, washer, or bracket thereon. Attached to the underside of the track 16 are a plurality of feet 20. Clip retainers 22 hold the clip or fastener 18 within the track 16. The clip retainers 22 may be made of a flexible spring steel that is compliant so as to move out of position permitting a clip or fastener 18 to pass, and then spring back into position. The fasteners 18 are fed into the track through opening 17.

Figures 2, 3:
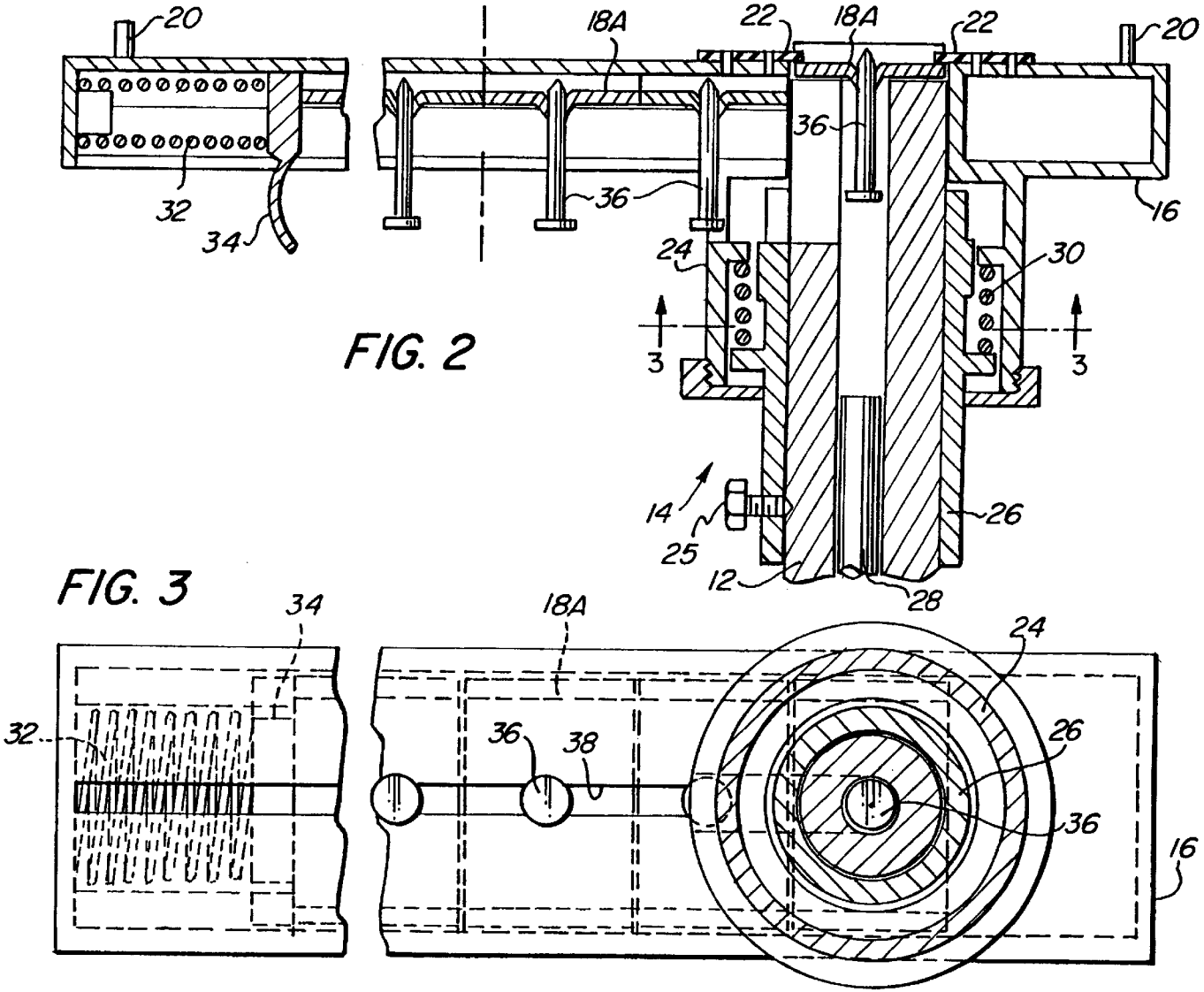
FIG. 2 is a cross section of the present invention.
FIG. 3 is a cross section taken along line 3—3 in FIG. 2.

FIG. 2 is a partial cross section illustrating the present invention. An outer cylinder 24 is placed around an inner cylinder 26. A hammer or driver 28 is reciprocally placed within the barrel 12. The hammer 28 is driven, typically by an explosive charge. The hammer 28 is driven downward and strikes the nail 36 held in clip or fastener 18A. Clip or fastener 18A is a flat washer, but may be any shape clip or fastener such as that illustrated in FIG. 1 having angled legs. For example, the clips or fasteners may have a shape such as that illustrated in U.S. Pat. No. 5,525,018 entitled "Fastener Assembly for Use with Power Actuated Gun" issuing to Losada on Jun. 11, 1996, which is herein incorporated by reference. A spring 30 is held captive between the inner cylinder 26 and the outer cylinder 24. The inner cylinder 26 is held onto the barrel 12 by a screw 25. The barrel 12 is thereby permitted to move up and down and is biased in an up position by spring 30. The fasteners or clips 18A are lined up within the track 16 and advanced forward by a spring 32. The spring 32 forces the row of fasteners 18A sequentially into position under the hammer or driver 28. Handle 34 may be used to pull back a stop and compress spring 32 for the loading of fasteners 18A. The fastener 18A, with its associated nail or stud 36, is held in place under the hammer or driver 38 by clips or retainers 22. The clips or retainers 22 are flexible and only hold the clips or fasteners 18A in position until being driven by the hammer or driver 28 of the power actuated gun. The feet 20 raise the track 16 off a surface of a substrate into which the fastener 18A is to be driven. This permits the fastener 18A to be ejected upon being driven into the surface.

FIG. 3 is a cross section taken along line 3—3 in FIG. 2. Clips or fasteners 18A are lined up within the track 16 and are advanced forward by spring 32. The nails or studs 36 extend through and are guided by a slot 38 until being positioned under the hammer or driver 28.

Figure 4:
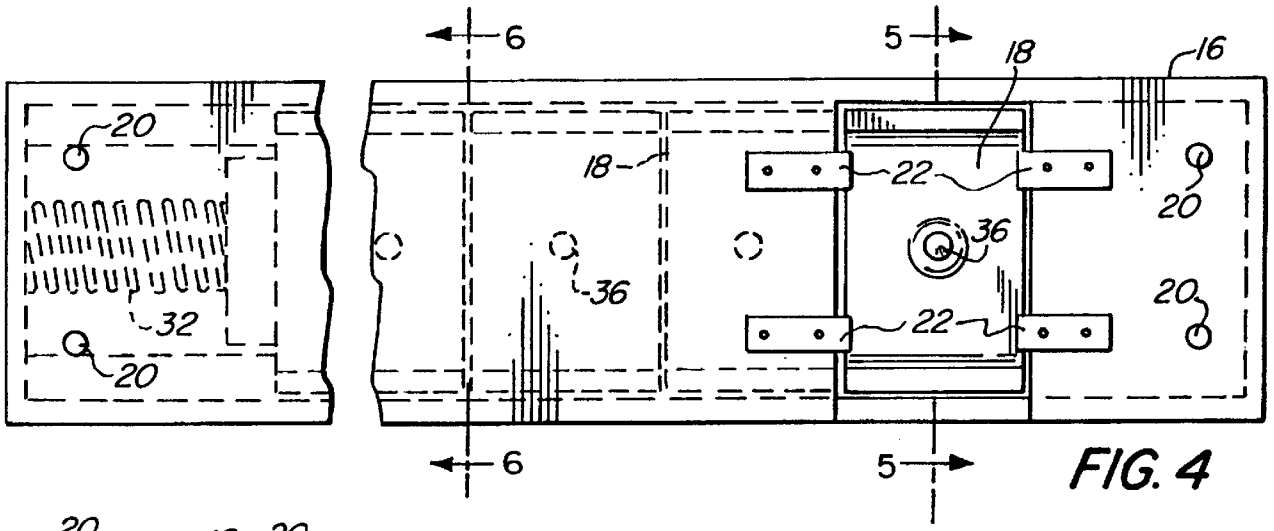
FIG. 4 is a bottom view of the track of the present invention.

FIG. 4 is a bottom view of a track 16 holding a slightly different fastener 18. Fastener 18 has angled legs forming a channel. A plurality of fasteners 18 are held in position by track 16. The clips or retainers 22 hold the fasteners 18 in position before being driven. The clips or retainers 22 are flexible and permit the fastener 18 to be passed there through upon being driven. Legs 20 hold the bottom surface of the track 16 off the surface which the fastener 18 is being driven into.

Figure 5:
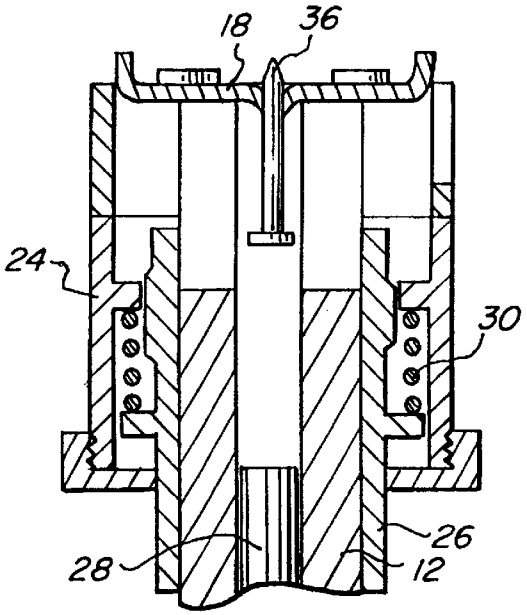
FIG. 5 is a cross section taken along line 5—5 in FIG. 4.

FIG. 5 is a cross section taken along line 5—5 in FIG. 4. FIG. 5 illustrates the fastener 18 in position to be driven. When being driven by the hammer or driver 28, the barrel 12 is pushed toward the fastener 18 or downward, compressing spring 30.

Figure 6:
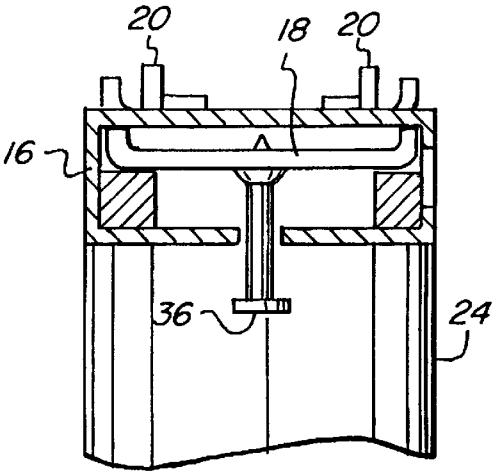
FIG. 6 is a cross section taken along line 6—6 in FIG. 4.

FIG. 6 is a cross section taken along line 6—6 in FIG. 4. FIG. 6 illustrates a clip 18 positioned within the track 16, ready to advance forward toward the firing position under the hammer or driver 28 of the power actuated gun.

Figure 7:
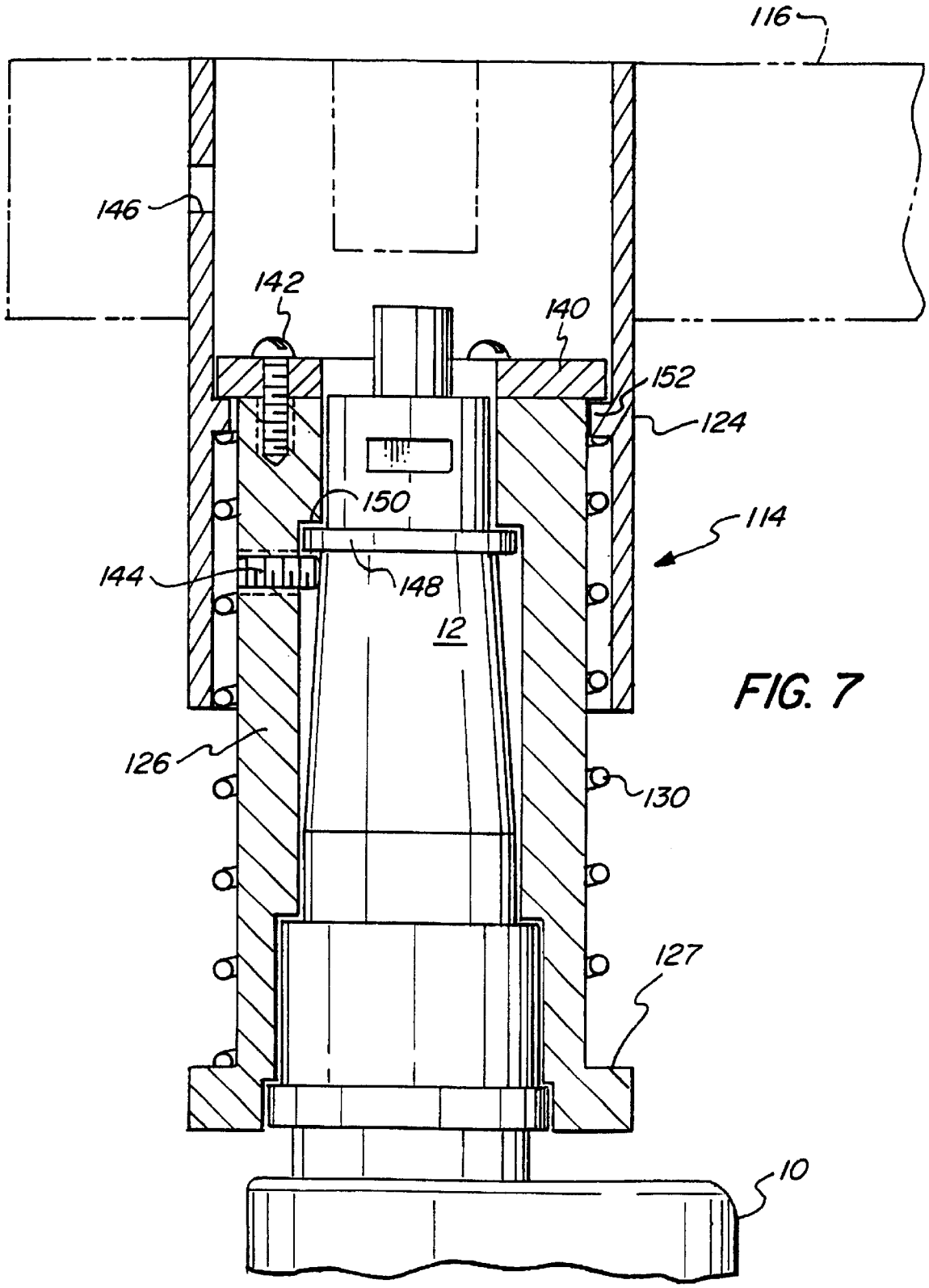
FIG. 7 illustrates another embodiment of the present invention.

FIG. 7 illustrates another embodiment of an attachment 114 that may be placed on a barrel 12 of a power actuated gun 10. In this embodiment, an inner cylinder 126 has an inner diameter that closely conforms to the shape of the barrel 12 of a power actuated gun 10. An outer cylinder 124 is placed over the inner cylinder 126. The outer cylinder 124 has an internal flange 152. The outer cylinder 124 is retained on the inner cylinder 126 by plate 140, which is threaded into the end of inner cylinder 126 by screws 142. The inner cylinder 126 is securely fastened to the barrel 12. The barrel 12 has an external flange 148 which rests against a shoulder 150 in the inner diameter of the inner cylinder 126. A set screw 144 is threaded into the inner cylinder 126 and placed adjacent the external flange 148 to securely hold the barrel 12 onto the inner cylinder 126. A spring 130 biases the outer cylinder 124 up against the plate 140. A track 116 shown in phantom is attached to the outer cylinder 124. Accordingly, the barrel 12 and power actuated gun 10 can be raised and lowered with respect to the outer cylinder 124 so that the barrel 12 of the power actuated gun 10 can come in contact with a fastener contained within the track 116, shown in phantom. The attachment 114 can easily be attached and removed from the barrel 12 of the power actuated gun 10 by compressing spring 130 such that the access hole 146 is lined up with the set screw 144, permitting it to be loosened or tightened respectively.

Figure 8:
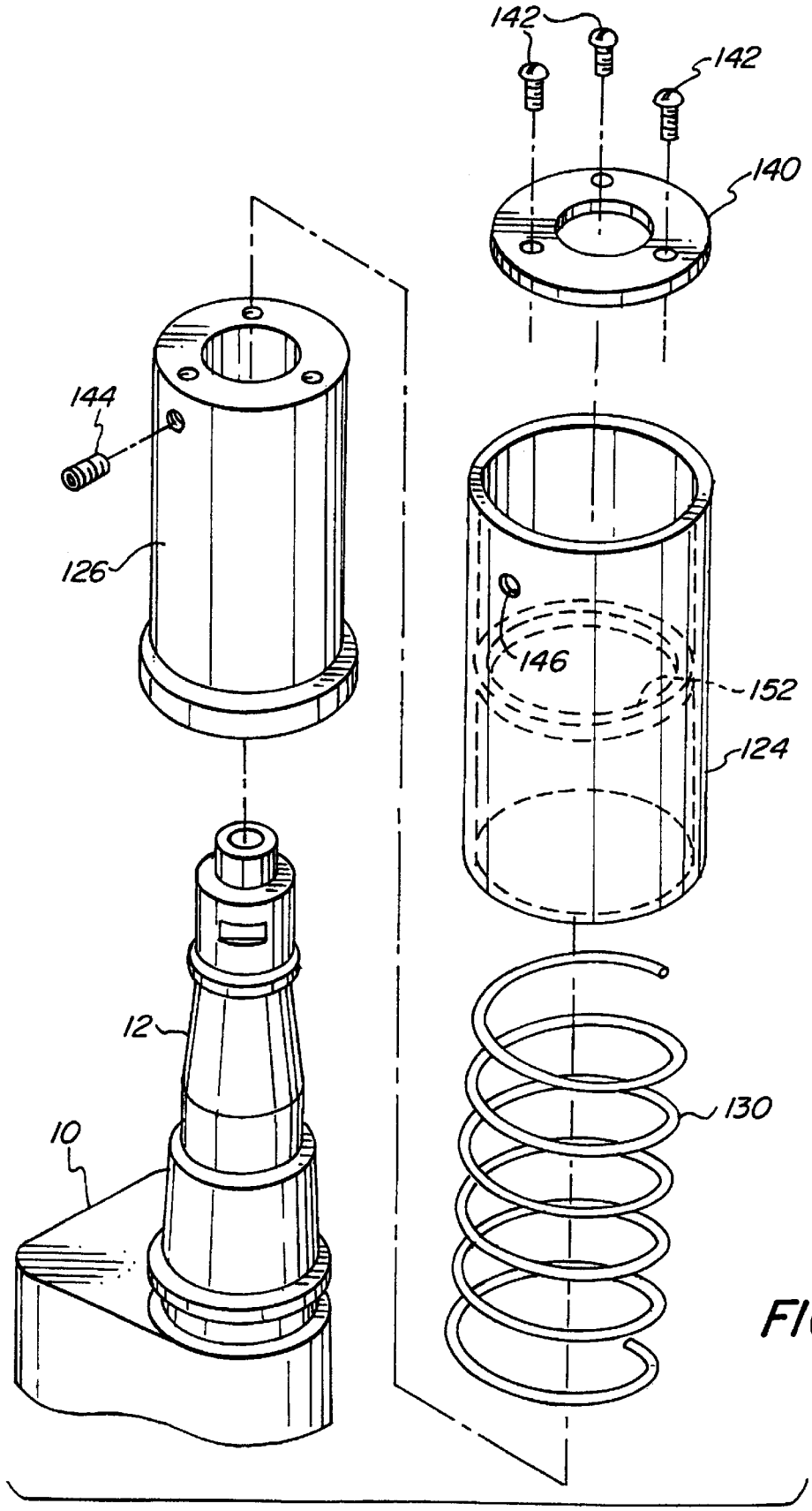
FIG. 8 is an exploded view of the embodiment illustrated in FIG. 7.

FIG. 8 is an exploded view illustrating the assembly of the embodiment illustrated in FIG. 7.

Figure 9:
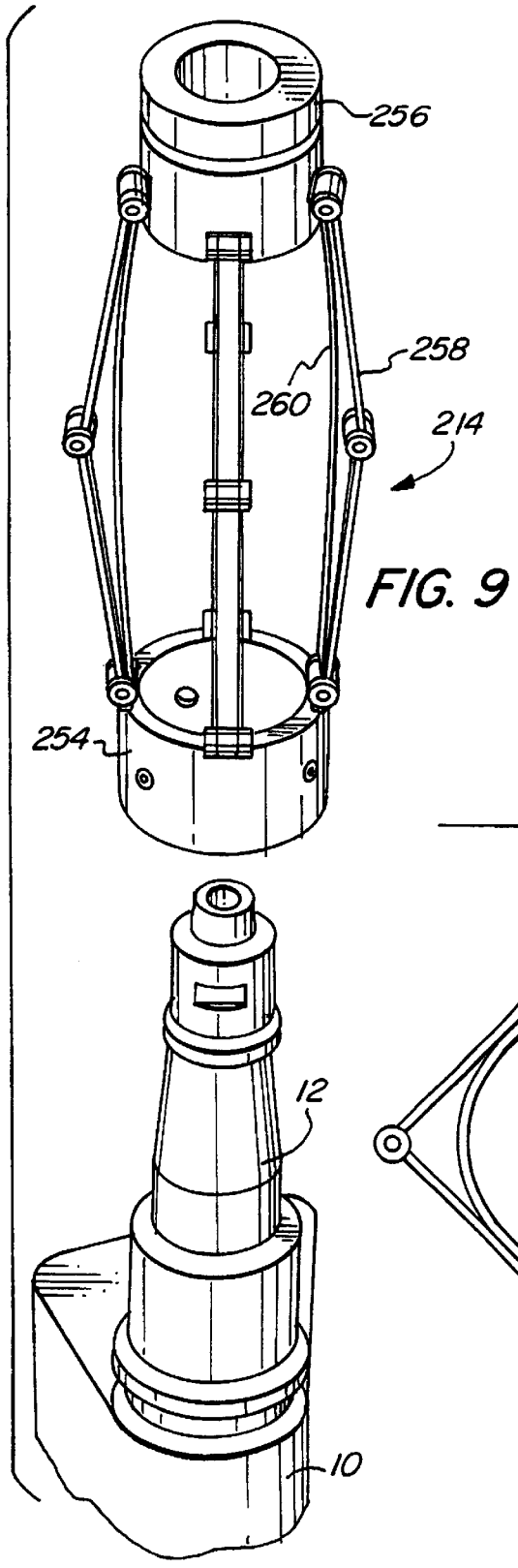
FIG. 9 is a perspective view illustrating another embodiment of the present invention.

FIG. 9 is another embodiment of the present invention utilizing a different structure. A bottom collar 254 is attached to barrel 12 of a power actuated gun 10. A track collar 256 is attached to the barrel collar 254 by a plurality of articulated legs or knee joints 258. Articulated legs or knee joints 258 are pivoted or articulated and can bend, causing the barrel collar 254 and the track collar 256 to come closer or further apart from each other. A spring 260 biases the bottom collar 254 and the track collar 256 away from each other.

Figure 10:
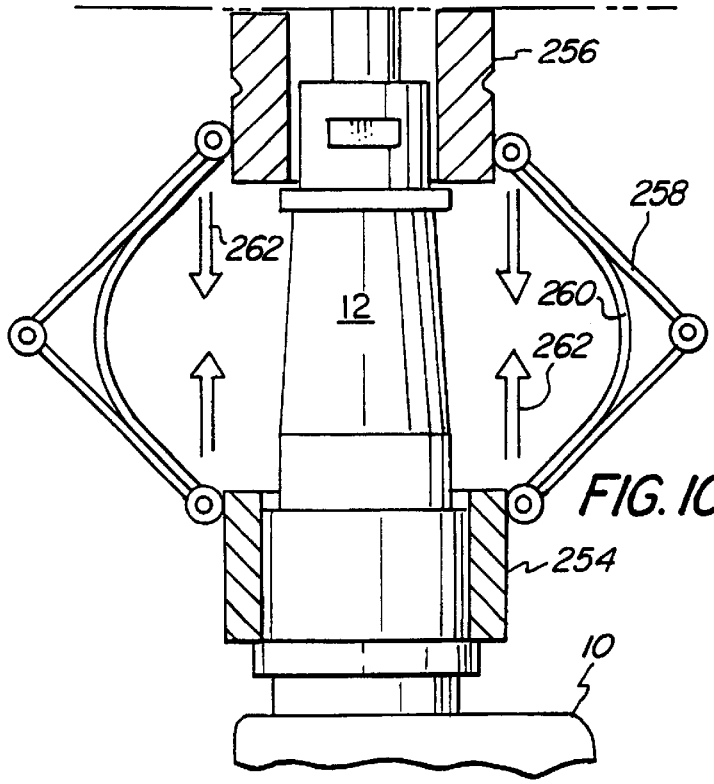
FIG. 10 is a schematic illustrating the operation of the embodiment illustrated in FIG. 9.

FIG. 10 illustrates the operation of the embodiment illustrated in FIG. 9. The articulated legs or knee joints 258 may be flexed so that they move in the direction of arrows 262, permitting the barrel of the power actuated gun to be raised and lowered to contact a fastener assembly which may be placed in a track, which is not shown. The track may be attached to the track collar 256 by any convenient means, such as that illustrated in the prior embodiments of the present invention. Additionally, other equivalent structures may be used that permit the barrel to be moved to engage a fastener.

Figures 11A, 11B:
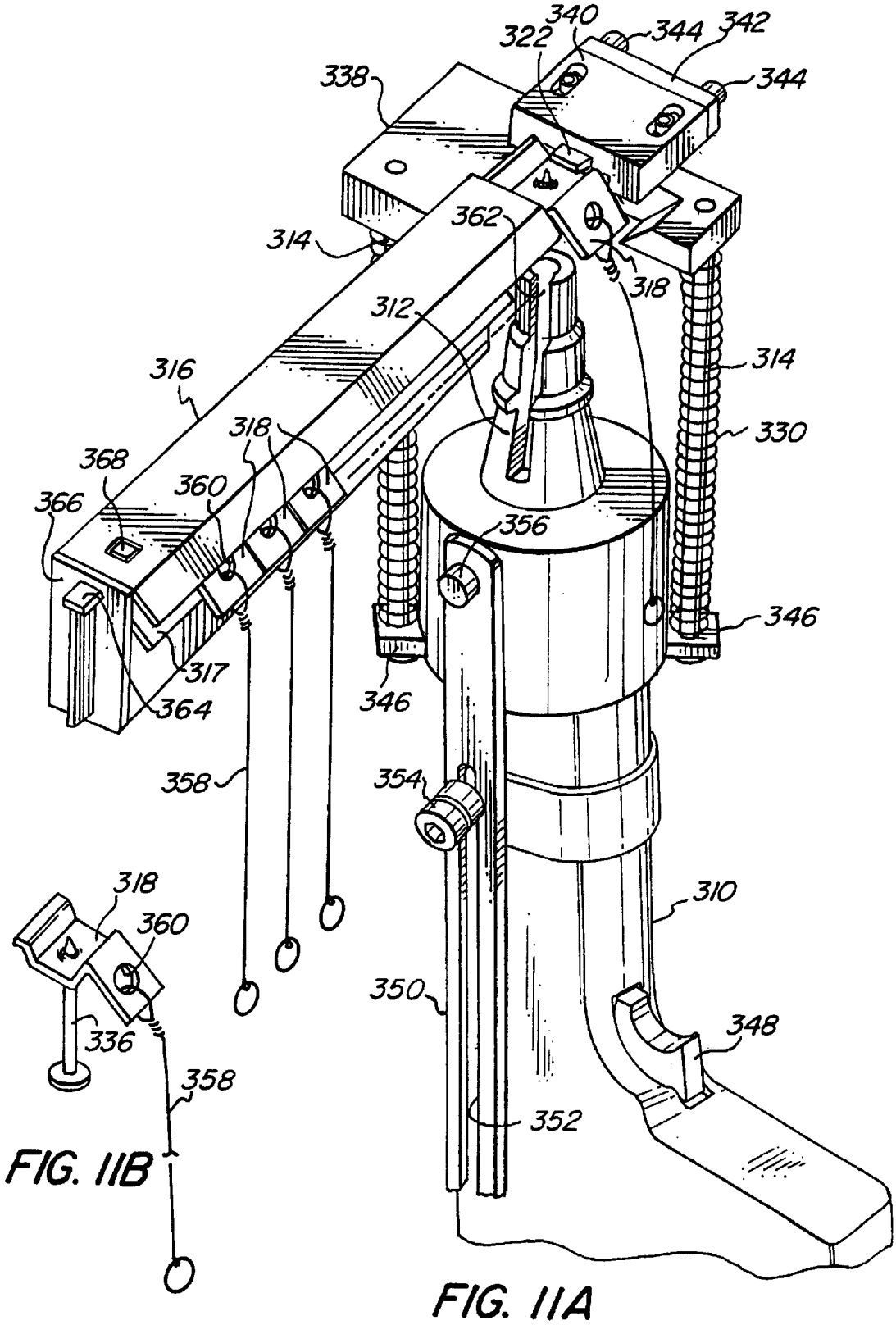
FIG. 11 is a perspective view of another embodiment of the present invention.

FIG. 11A illustrates another embodiment of the present invention. In FIG. 11A, a power actuated gun 310 has a barrel 312 attached thereto. Attached to a portion of the power actuated gun 310 is lower guide rod supports 346. The lower guide rod supports 346 may be attached with threaded fasteners, not shown, welded, or attached by any other equivalent way to the power actuated gun 310. Attached to the lower guide rod supports 346 are guide rods 314. Guide rods 314 have a helical spring 330 associated therewith. The guide rods 314 are placed within the helical springs 330. One end of the guide rods 314 is slidably placed within the lower guide rode supports 346. This permits the power actuated gun to be advanced up or forward to contact a fastener 318 to be driven. The other end of the guide rods 314 is attached to upper guide rod support 338. The upper guide rod support 338 is generally rectangular. However, in this embodiment it has a cut-out portion in one corner. Attached to the guide rod support 338 is a housing 340. The housing 340 contains a retractable or releasable latch mechanism with a portion of a fastener retainer 322 extending therefrom. A cover 342 and screws 344 retain the latch mechanism within the housing 340. Also attached to the upper guide rod support 338 is a track 316. The track 316 is adapted to retain and hold a plurality of angled fasteners 318.

FIG. 11B more clearly illustrates an angled fastener 318 that is retained within the track 316 illustrated in FIG. 11A. The fasteners 318 have a channel and angled portion extending therefrom. Accordingly, the fasteners 318 may be considered non-planar because they are not flat forming a single plane. Within the angled portion or leg is a hole 360. A wire 358 is often attached to the angled portion and tied through the hole 360. Frictionally retained within the channel portion of the fastener 318 is a nail or stud 336.

A plurality of fasteners 318 are inserted into the track 316. Track 316 has an opening 317 for permitting the angled portion of the fasteners 318 to extend therefrom. A track end cover 366 is used to retain the plurality of clips 318 within the track 316. The track end cover 366 has a catch 368 to hold the track end cover 366 onto the track 316 and a release 364. The track end cover 366 holds the plurality of fasteners 318 within the track 316. Additionally, attached to the track end cover 366 is a spring mechanism used to advance or bias in a forward direction the plurality of fasteners 318 placed within track 316. In this embodiment, the barrel 312 of the power actuated gun 310 has a longitudinal slot 362 therein having a lateral dimension sufficient to accept the extended nail portion frictionally retained within the fasteners 318. Accordingly, as the fasteners 318 are advanced forward by a spring attached to the track end cover 366, the clips are sequentially fed and forced adjacent to the housing 340 and held into position by latch 322 prior to being driven by the power actuated gun 310. After being positioned against the fastener 318, the power actuated gun 310 is fired by pulling trigger 348. When power actuated guns are used that need to be cocked between firings, a cocking mechanism may be included to remotely cock the power actuated gun. The cocking mechanism may include a cocking lever 350 having a slot 352 therein. One end of the cocking lever 350 is attached to the power actuated gun 310 by a bolt or pin 356. Another portion of the cocking lever 350 is slidably attached to the body of the gun 310 with a lever guide 354. This permits the cocking lever 350 to be used to push the upper portion of the power actuated gun 310 upwards from a location remote to the gun in order to cock the power actuated gun 310 without removing it from a firing location. Additionally, a mechanism may be attached to pull the trigger 348 to fire the power actuated gun after being cocked. However, some power actuated guns do not require cocking and can be repeatedly fired without cocking. When these types of power actuated guns are used, no remote cocking mechanism is needed.

FIGS. 12A and 12B more clearly illustrate the feeding mechanism of this embodiment of the present invention. FIG. 12A illustrates an initial position in which one of the fasteners 318 is positioned adjacent the housing 340 and latch 322, and in a position to be driven by a driver 384 within the barrel 312 of a power actuated gun 310. A fastener feeding end 374 is advanced forward by a helical spring 372 in a direction indicated by arrow 386. As the fastener feeding end 374 is biased forward by the spring 372, the line of fasteners 318 abut each other and are forced forward such that the first fastener is positioned adjacent the holding mechanism, including latch 322. The latch 322 has a latch extension 376 which extends over a portion of the first fastener 318. Below the latch extension 376 is a cam surface 378. Between the latch extension 376 and the cam surface 378, a portion of the fastener 318 is retained. The latch 322 is biased adjacent the fastener 318 by a fastener spring 380. Between the track 316 and the fastener housing 340 is a space or gap through which the first fastener 318 held in a predetermined position may pass for driving into a substrate, not illustrated.

FIG. 12B illustrates the operation of the holding or latching mechanism when the barrel 312 is pressed against the nail or stud 336 and the clip or fastener 318 is driven into a substrate by the power actuated gun. The exterior surface of barrel 312 strikes the cam surface 378 of the latch 322, causing the latch 322 to move away from the fastener 318 in the direction of arrow 387. This causes the latch extension 376 holding a portion of the fastener 318 to retract away from the fastener 318 as the barrel 312 is pressed upward in the direction of arrow 388.

FIG. 13 is a front elevational view looking at the holding mechanism rotated ninety degrees from the view illustrated in FIGS. 11A–B. This view more clearly illustrates clip holding pins 382 placed on either side of the latch extensions 376 which help to retain the clip 318 within the feeding mechanism. Accordingly, a lower or bottom portion of the fastener 318 is held by pins 382 with the latch extension 376 holding an opposing upper or top surface of the fastener 318 between the two pins 382. Accordingly, a triangular three-point holding system is created which securely holds fastener 318 in a predetermined position before being driven by the power actuated gun.

Figure 14:
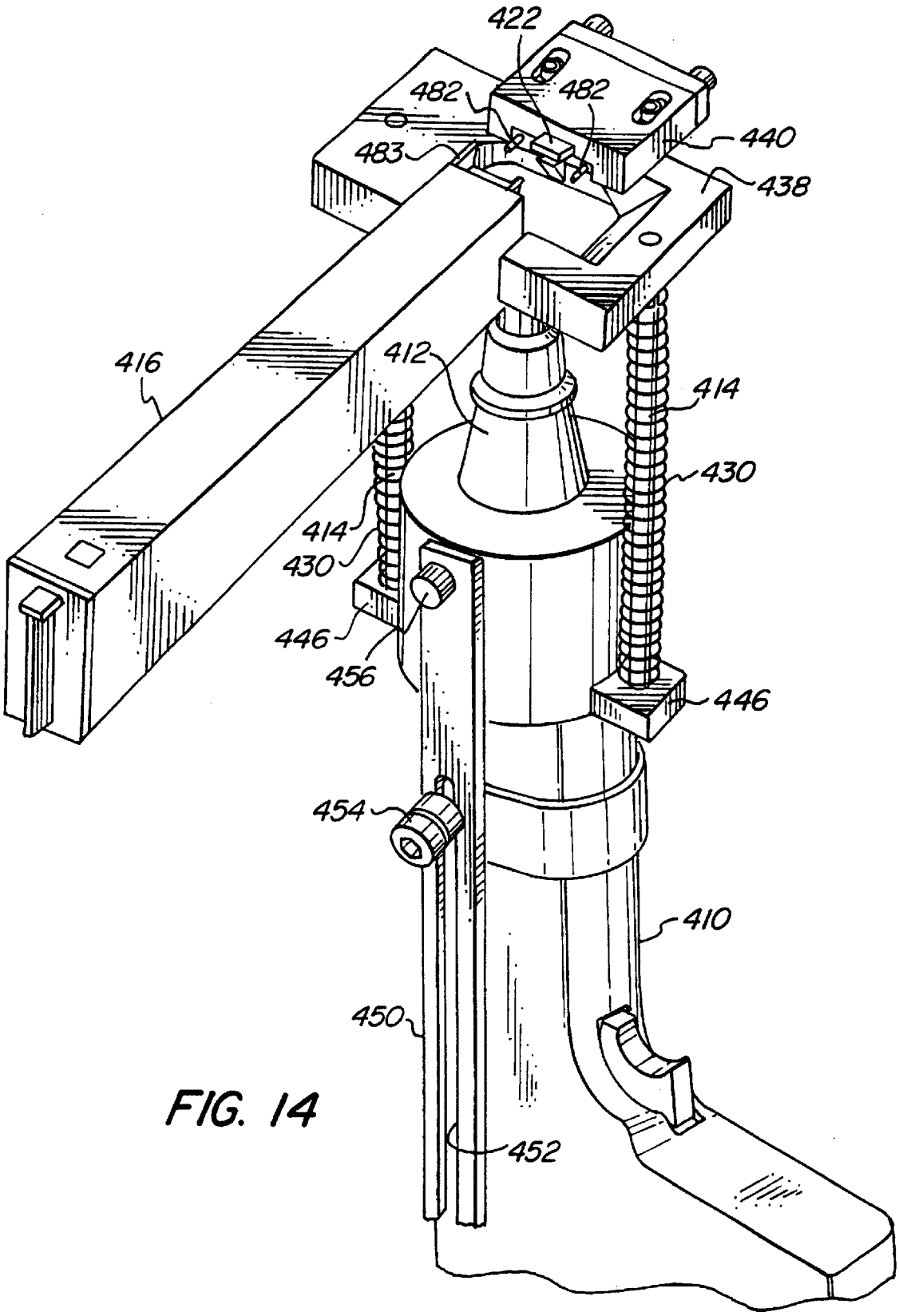
FIG. 14 is a perspective view of another embodiment of the present invention.

FIG. 14 illustrates another embodiment of the present invention. In this embodiment, the feeding mechanism is modified slightly and is adapted for a fastener that may not have a leg or angled portion attached therefrom. Accordingly, a closed track 416 is utilized and having a similar construction as that disclosed in the prior embodiment. The track 416 is attached to an upper guide rod support 438. The upper guide rod support 438 has an opening therein and does not need to be cut away at one corner. Additionally, the guide rods 414 and the lower guide rod supports 446 do not have to be angled or skewed, as in the embodiment illustrated in FIG. 11A. A housing 440 containing a latch 422 and fixed pins 482 is attached to the upper support 438. One end of the track 416 is also attached to the upper support 438. Additionally, in this embodiment, a flexible corner support 483 is attached to the track 416 to provide additional support for retaining a fastener, not illustrated. However, with sufficiently long fastener holding pins 342, the flexible corner support 483 may not be needed. The operation of this embodiment is similar to that illustrated and described with respect to FIG. 11A. As the barrel 412 is advanced preparing to fire, springs 430 are compressed causing guide rods 414 to slide through lower guide rod supports 446. The barrel 412 is aligning with a fastener, not illustrated, and the latch 422 is caused to retract, releasing a fastener, and permitting it to be moved through the opening formed within the upper support 438. The power actuated gun 410 may also have a cocking mechanism associated with it. The cocking mechanism may include a cocking lever 450 having a slot 452 therein, through which pin 454 may slide with one end of the cocking lever 450 attached to the power actuated gun 410 by a pin 456. However, as indicated previously, some power actuated guns may not need to be cocked and may be fired repeatedly without cocking. Accordingly, the cocking lever structure would not be needed.

Figure 15:
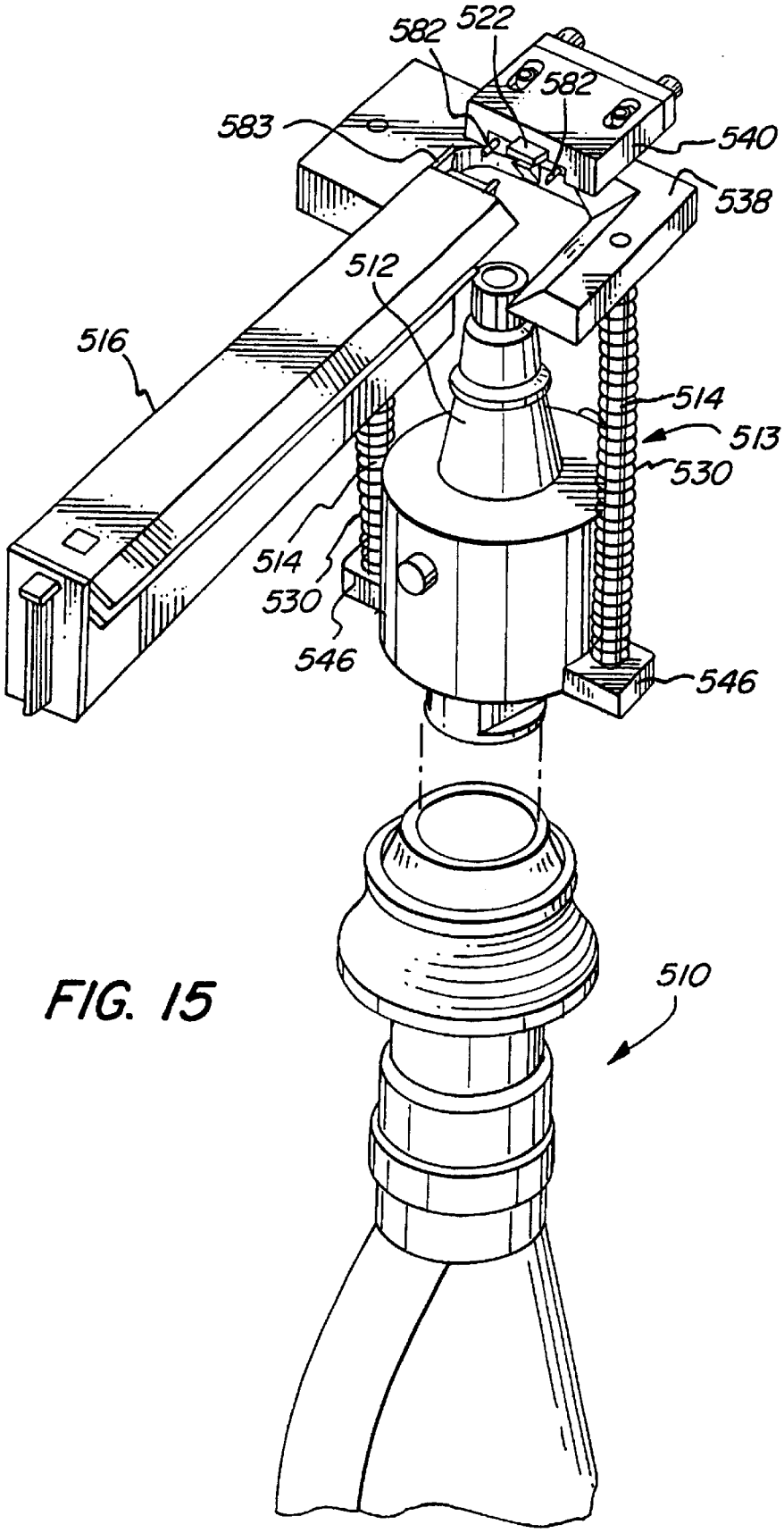
FIG. 15 is a perspective view of another embodiment of the present invention with a detachable barrel portion.

FIG. 15 is a perspective view illustrating yet another embodiment of the present invention. In this embodiment, a removable or detachable barrel assembly 513 is utilized which permits easily interchanging different fastener feeding tracks with a single power actuated gun 510. Accordingly, the barrel assembly 513 is readily detachable from the power actuated gun 510 and contains thereon a guide rod support 538 and a latch mechanism housing 540 with pins 582 attached thereto and a retractable latch 522 placed therein. Additionally, a flexible corner fastener support 583 may be used. The flexible corner fastener support 583 may be made of spring metal, which is flexible, is easily moves upon the application of force, and springs back into position after a fastener passes through the opening. Accordingly, as the barrel 512 is pressed up, forward, or towards the fastener, the guide rods 514 are caused to slide through the bottom guide rod supports 546, compressing the springs 530. This causes the barrel 512 to contact a fastener, not shown, contained within the feeding mechanism and held by the latch 522 and pins 582 and flexible corner support 583. After being fired and upon releasing pressure, the barrel 512 will retract due to the biasing of compressed springs 530, permitting another fastener to be advanced forward within track 516 and forced adjacent the latch housing 540 in a predetermined position, ready to be driven by the power actuated gun.

Figure 16:
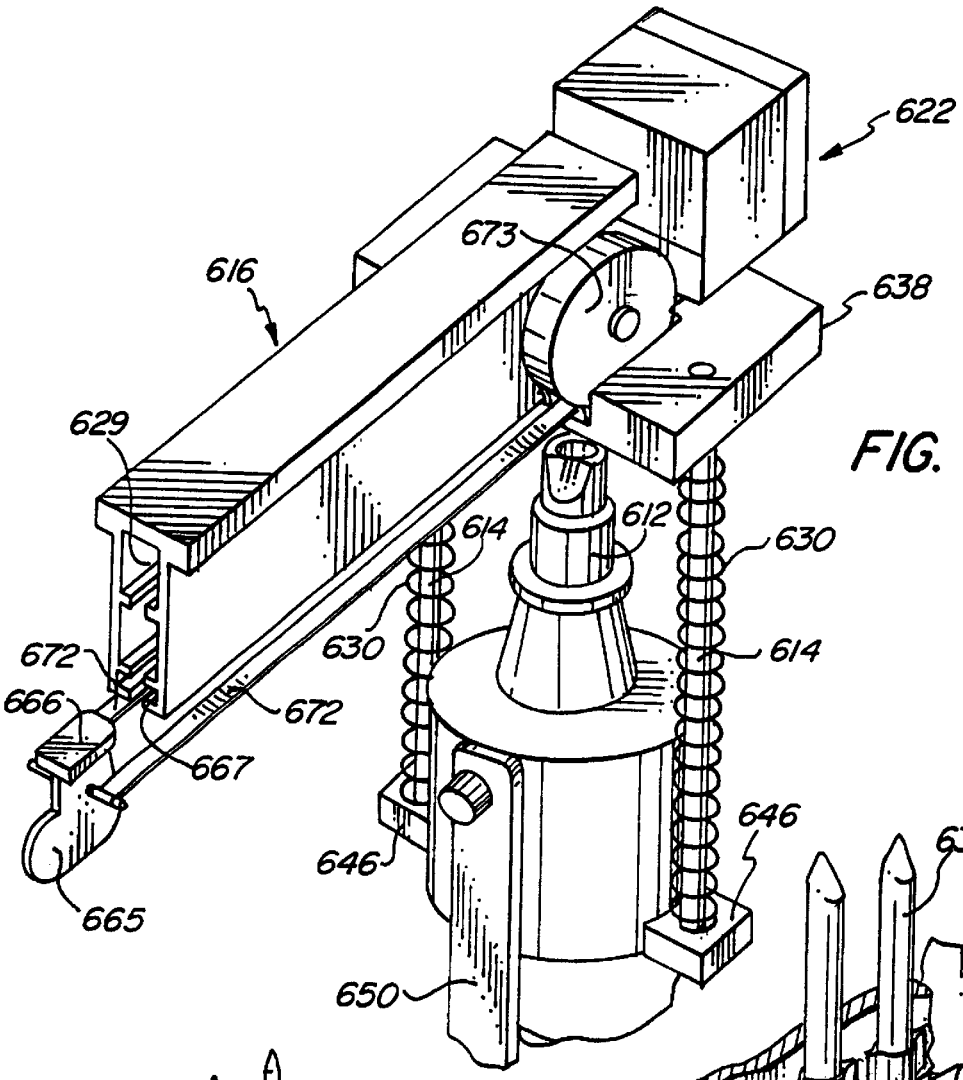
FIG. 16 is a perspective view of yet another embodiment of the present invention used in feeding loose nails.
Figure 18:
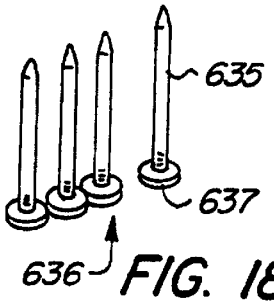
FIG. 18 is a perspective view of a group of loose nails.
Figure 17:
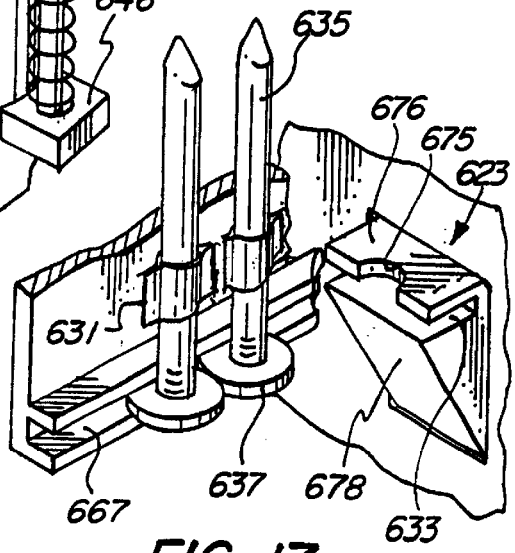
FIG. 17 is a perspective view more clearly illustrating the feeding mechanism of the embodiment of the present invention illustrated in FIG. 16.
Figure 19A:
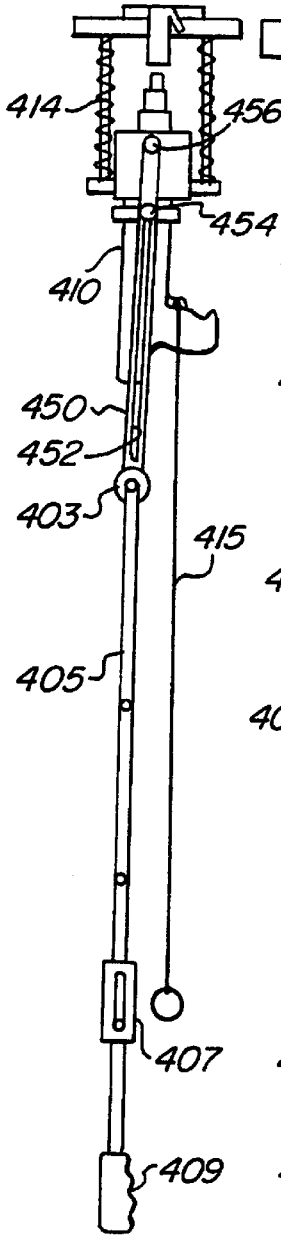
FIGS. 19A–D illustrate yet another embodiment of the present invention with an extended cocking feature.
Figure 19B:
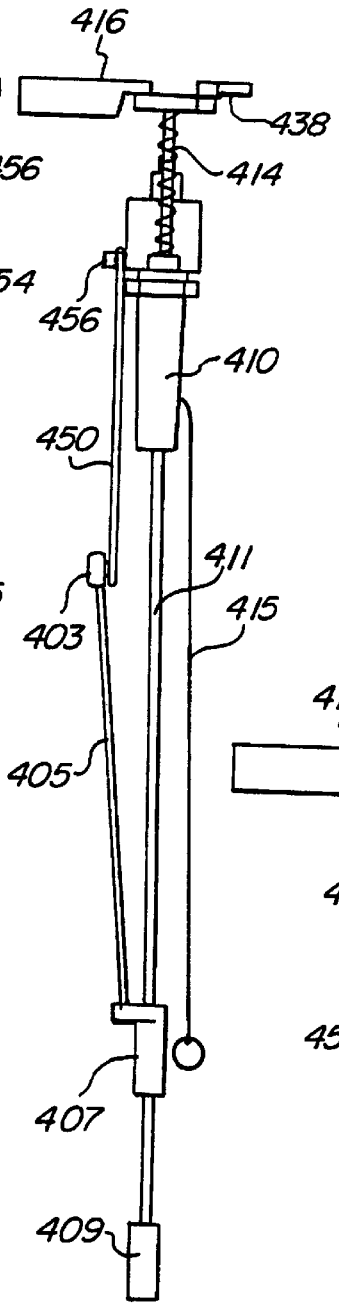
Figure 19C:
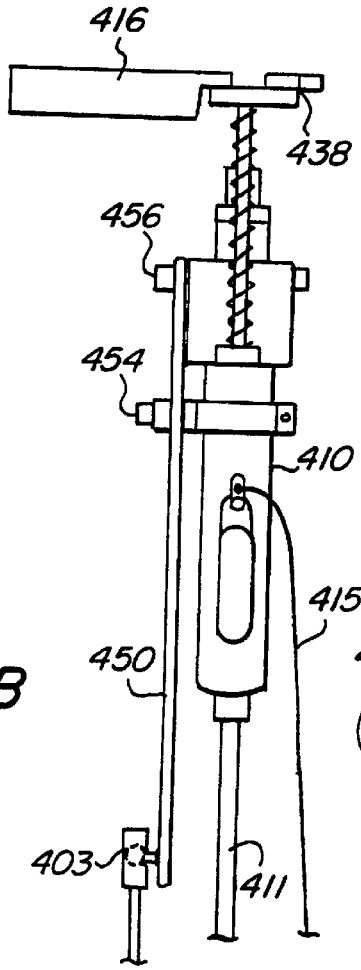
Figure 19D:
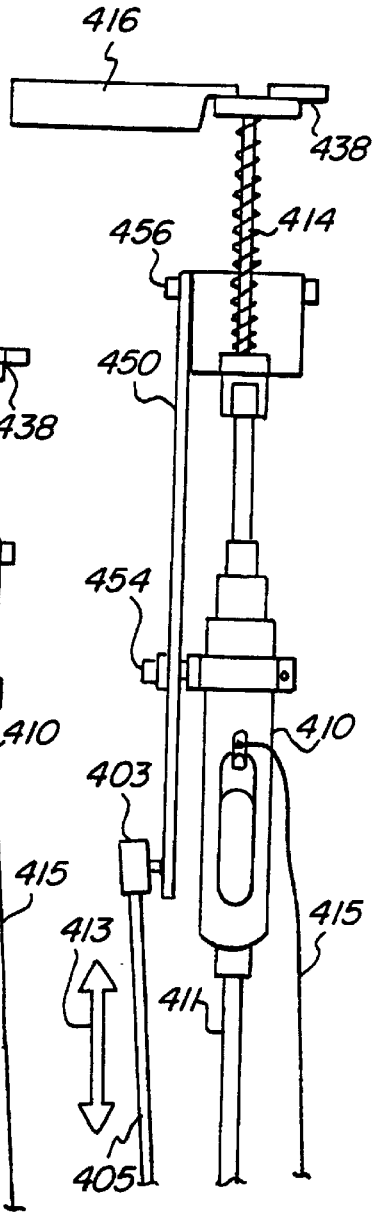

FIGS. 16, 17 and 18 illustrate another embodiment that is adapted to hold and drive loose nails 636, illustrated in FIG. 18. Each of the loose nails 636 have a shaft 635 and a head 637 and are placed within the track 616. The track 616 has an opening with a head guide 667 and a shaft guide 629. The loose nails 636 may be slid into the opening within track 616. Track end 666 is adapted to slide within the track head guide 667, advancing the nails forward and adjacent a latch assembly 622 at one end thereof. FIG. 17 is a partial cut away illustration of latch assembly 622, illustrated in FIG. 16, more clearly illustrating the structure and operation of the latch assembly. The track end 666 is pulled forward by a ribbon of spring steel 672 on either side of track 616. The ribbon of spring steel is coiled within housing 673. Accordingly, the spring steel 672 is biased to coil within the coil housing 673 which causes the track end 666 to bias forward towards the barrel 612 causing the loose nails placed within the track 616 to be advanced and held adjacent the latch assembly 622. As more clearly illustrated in FIG. 17, lining up with the track head guide 667 is a slot 633 placed within a latch 623. Above and adjacent the slot 633 is latch extension 676 that has a semi-circular shaft recess 675 therein. Below and on the other side of slot 633 is a cam surface 678. The slot 633 is adapted to receive the head 637 of an advancing nail or stud. The recess 675 is adapted to hold the shaft 635, centering and retaining the nail in position for being driven by the power actuated gun. To further help guide and hold the nails or fasteners within the barrel of a power actuated gun, flutes 631 may be placed around the shaft 635. Similar to the operation of the prior embodiments, when the barrel 612 of the power actuated gun is advanced, the outer circumference of the barrel 612 strikes cam surface 678 causing the latch 623 to retract, releasing the head 637 of the nail, and permitting it to be driven by the power actuated gun. Accordingly, as the barrel 612 is advanced upward and forward, the rods 630 slide through the lower rod supports 646 causing the coil springs 614 to compress, permitting the barrel 612 to come into contact with the cam surface 678 on the latch 623. The nails 636 are thereby released and driven by the power actuated gun. Upon release of pressure from the power actuated gun, the springs 630 bias the barrel 612 away from the feeding mechanism, resulting in the advance of another nail or fastener for the next firing operation. A cocking lever 650 may be used to cock the gun between firings. However, some guns do not need cocking and therefore the cocking lever 650 would not be needed.

FIGS. 19A–D illustrate the present invention utilizing a cocking and firing assembly that is advantageous when the power actuated gun is used to drive fasteners at a distant location, such as when fasteners are placed in a ceiling. This prevents a worker from having to use a ladder, and the power actuated gun can be used remotely from the floor or ground. The remote firing mechanism is particularly applicable when the fastener feeding mechanism of the present invention is utilized. This prevents the necessity and inconvenience of having to climb a ladder, fire the gun, insert a new fastener, cock the gun, and fire the gun again. The present invention makes practical the repetitive driving of fasteners in a ceiling without having to reload a gun or climb a ladder. For convenience and simplicity, this embodiment illustrates the power actuated gun 410 illustrated in FIG. 14. The power actuated gun 410 having guide rods 414 attached to a feeding mechanism having a track 416 and an upper guide rod support 438, is illustrated. A cocking lever 450 is attached to the power actuated gun 410 with a pin 456. A lever guide 454 is also attached to the gun 410 and permits the cocking lever 450 to slide up and down within a slot 452. Attached to the cocking lever 450 by a joint 403 is a lower cocking lever 405. Lower cocking lever 405 has an upper handle 407 thereon which is permitted to slide over an extension rod 411 attached to the gun 410. At one end of the extension rod 410 is a lower handle 409. Also attached to the power actuated gun 410 is a trigger pull 415. Accordingly, with reference to FIGS. 19A–D, the operation of the remote firing and cocking mechanism should be readily appreciated. While holding upper handle 407 with one hand and lower handle 409 with another hand, the user or worker may push upward in the direction of arrow 413, causing a portion of the power actuated gun 410 to be raised upward, cocking the gun so that the gun can be ready for driving another fastener. Additionally, trigger pull 415 may be used to activate the trigger from a distance. The remote cocking and firing mechanism is of great convenience when a power actuated gun is utilized that does not have automatic cocking and must be manually cocked. Accordingly, in combination with the feeding mechanism, multiple fasteners may be driven into a substrate at a remote location, such as a ceiling, without the user or worker having to climb a ladder with a heavy gun and fire individual rounds for fastening a multitude of fasteners.

The present invention may also be adapted for used with fasteners having a nail or stud loosely held to a plate rather than press fit into the plate. Typically, the pointed end of the stud has a sleeve with a flange press fit to it, called an eyelet or top hat, that prevents the loose stud from falling out of a hole in a plate forming the fastener. The retainers 22, in FIG. 1, or the latch 322, in FIG. 11A, could be extended to hold the flange near the stud so that the stud would be held in position during firing or driving.

Accordingly, the present invention of a feeding mechanism for a power actuated gun for feeding a plurality of loose fastener or nails greatly facilitates the speed at which fasteners may be driven. Accordingly, construction time can be greatly reduced, as well as the cost associated therewith. Additionally, various modifications have been illustrated with different features and advantages from which it should be clear that the different features of the different embodiments may be combined in different combinations without departing from the spirit and scope of the present invention. Additionally, minor modifications may be made with the structure of the present invention which may be equivalent to the operation and structure disclosed, while embodying the spirit and scope of the present invention. Additionally, it should be readily appreciated that the present invention provides a fastener feeding system that can be adapted and attached to any number of existing power actuated guns that greatly facilitates the rapid firing of multiple fastener assemblies without the need to individually place a fastener assembly within the barrel of a power actuated gun. This greatly increases productivity and helps reduce construction costs.

What is claimed is:

1. A fastener feeding device for a power actuated gun comprising:

a support;

a track adapted to receive a plurality of fasteners attached to said support at one end, said track having an opening at the one end;

biasing means, associated with said track, for biasing the plurality of fasteners within said track toward the one end;

latching means, associated with said support, for holding one of said plurality of fasteners in a predetermined position ready to be driven by the power actuated gun; and guide means, attached to the power actuated gun, for guiding a barrel of said power actuated gun into position adjacent the one of said plurality of fasteners, wherein said guide means comprises a plurality of articulated legs.

2. A fastener feeding device for use with a power actuated gun comprising:

an inner cylinder conforming to a barrel of the power actuated gun and positioned over the barrel with a fastener receiving end of the barrel extending out of said inner cylinder;

an external flange placed adjacent an open end of said inner cylinder;

a set screw threaded into said inner cylinder and attaching said inner cylinder to the barrel;

an outer cylinder placed over said inner cylinder;

an internal flange positioned intermediate either open end of said outer cylinder;

a spring placed around said inner cylinder and within said outer cylinder and retained between said internal flange on said outer cylinder and said external flange on said internal cylinder;

a plate placed within said outer cylinder and attached to an end surface of said inner cylinder, said plate having a diameter sufficient to contact said internal flange; and a fastener feeding track attached to said outer cylinder, said fastener feeding track adapted to receive a plurality of fasteners having a plate, whereby said fastener feeding track positions a fastener in a position to contact the barrel of a power actuated gun when guided by said inner and outer cylinders.

3. A power actuated gun fastener feeding mechanism and fastener comprising:

a support plate having an opening though which a fastener may pass;

a latch housing attached to said support plate adjacent a first side of the opening;

a latch slidably positioned within said latch housing and sliding in a first plane parallel to said support plate;

a spring biased said latch outward from said latch housing towards the opening;

a cam surface on said latch, said cam surface positioned to contact a barrel of a power actuated gun;

at least two pins positioned on either side of said latch in a second plane, said second plane parallel to, but displaced from said first plane, whereby said at least two pins are positioned to contact one surface of a fastener having a non-planar plate and said latch is positioned to contact the other opposing surface of the non-planar plate;

a track attached to said support plate adjacent the opening opposite said latch, said track having a shape to match and receive the non-planar plate of the fastener, whereby a plurality of fasteners are held by said track and permitted to slide towards said support;

a track end cover placed on an end of said track;

a spring attached to said track end cover and received by said track, whereby said spring biases the plurality of fasteners towards said latch;

a release attached to said track end cover and releasably attaching to said track;

a pair of guide rods having a fixed end and a sliding end, the fixed end of each of said pair of guide rods attached to said support plate;

a lower support attached to a power actuated gun, the sliding end of each of said pair of guide rods slidably attaching to said lower support;

a pair of guide springs, one of said pair of guide springs placed over one of said pair of guide rods between said support plate and said lower support, whereby when the power actuated gun is moved toward said support plate said pair of guide springs is caused to compress biasing said power actuated gun away from said support plate.

4. A power actuated fastening system comprising:

a power actuated gun having a barrel and a trigger;

a plurality of loose fasteners having a non-planar plate;

a lower support attached to said power actuated gun;

a pair of guide rods having a sliding end and a fix end, the sliding end of said pair of guide rods retained by said lower support;

a support plate having a fastener opening, the fixed end of each of said pair of guide rods attached to said support plate;

a pair of helical guide springs, one of said pair of helical guide springs placed over one of said pair of guide rods between said support plate and said lower support, whereby when said power actuated gun is moved toward said support plate said pair of guide springs is caused to compress biasing said power actuated gun away from said support plate;

a latch housing attached to said support plate adjacent a first side of the opening;

a latch slidably positioned within said latch housing and sliding in a first plane parallel to said support plate;

a spring biased said latch outward from said latch housing towards the opening;

a cam surface on said latch, said cam surface positioned to contact the barrel of said power actuated gun;

at least two pins positioned on either side of said latch in a second plane, the second plane parallel to, but displaced from, said first plane, whereby said at least two pins are positioned to contact one surface of one of said plurality of fasteners and said latch is positioned to contact the other opposing surface of the one of said plurality of fasteners;

a track attached to said support plate adjacent the opening opposite said latch, said track having a shape to match and receive said plurality of fasteners, whereby said plurality of fasteners are held by said track and permitted to slide towards said support;

a track end cover placed on an end of said track;

a spring attached to said track end cover and received by said track, whereby said spring biases the plurality of fasteners towards said latch;

a release attached to said track end cover and releasably attaching to said track;

a cocking lever having a slot attached to a portion of said power actuated gun;

a cocking lever guide attached to another portion of said power actuated gun placed within the slot;

a lower cocking lever attached to said cocking lever;

an extension rod having a first extension rod end attached to a handle of said power actuated gun and a second extension rod end;

a lower handle attached to the second extension rod end;

an upper handle placed between the first extension rod end and the second extension rod end around said extension rod such that said upper handle is slidably attached to said extension rod; and a trigger pull attached to the trigger of said power actuated gun, whereby said power actuated gun may be fired a multitude of times from a remote location without having to reload said power actuated gun with one of said plurality of fasteners each time said power actuated gun is fired.

* * * * *